US005573354A

United States Patent [19]

Koch

[11] Patent Number: 5,573,354

[45] Date of Patent: Nov. 12, 1996

[54] TIMBER PILE REPAIR SYSTEM

[75] Inventor: James L. Koch, Forest Lake, Minn.

[73] Assignee: Restoration Technologies, Inc., Minneapolis, Minn.

[21] Appl. No.: 385,652

[22] Filed: Feb. 8, 1995

[51] Int. Cl.[6] ..... E02D 5/06

[52] U.S. Cl. ..... 405/216

[58] Field of Search ..... 405/211, 216, 405/232; 52/514, 170

[56] References Cited

U.S. PATENT DOCUMENTS

| | | | |
|---|---|---|---|
| 3,362,124 | 1/1968 | Cravens et al. . | |
| 4,306,821 | 12/1981 | Moore | 405/216 |
| 4,439,070 | 3/1984 | Dimmick | 405/216 |
| 4,702,057 | 10/1987 | Phillips . | |
| 4,983,072 | 1/1991 | Bell, Jr. . | |
| 5,175,973 | 1/1993 | Owen et al. . | |
| 5,226,751 | 7/1993 | Doleshal | 405/216 X |
| 5,337,469 | 8/1994 | Richey . | |

FOREIGN PATENT DOCUMENTS

| | | | |
|---|---|---|---|
| 8216728 | 4/1984 | France | 405/232 |

*Primary Examiner*—William P. Neuder
*Attorney, Agent, or Firm*—Jacobson & Johnson

[57] ABSTRACT

A two-part pile splice forming a pile protector and reinforcer and a method for reinforcing a deteriorated wood pile under a bridge wherein a first pile-protector and reinforcer-member having a flange is positioned on one side of a deteriorated wood pile with the flange located parallel to the flow of water under the bridge, and a second pile-protector and reinforcer-member with opposite flange is positioned on the opposite side of the wood pile with the flanges of the second pile protector and reinforcer spaced from and parallel to flow of water under the bridge. The pile protector and reinforcers are squeezed around the pilings to form a mechanical link thereto but not crash the wood piles and an epoxy which provides the compressive strength for the wood pile is filled into those areas in which the wood pile has voids.

15 Claims, 3 Drawing Sheets

TIMBER PILE REPAIR SYSTEM

FIELD OF THE INVENTION

This invention relates generally to wood-pile protectors and a method of repairing wood piles by using a pile splice to form a mechanical link between two portions of a wood pile located on opposite sides of a decayed portion of the wood pile to provide torsional and flexural strength to the pile and then filling any voids with a filler to provide compressive strength to the pile.

BACKGROUND OF THE INVENTION

The concept of damage to wood piles on river bridges caused by flowing debris and repairing wood piles by using a flexible sleeve which extends around the pole and then inserting a filler such as an epoxy into the sleeve to fill any cavities between the sleeve and pile is old in the art. While multiple methods and sleeves are available for repairing the piles, each method requires time-consuming procedures and apparatus for supporting the pile. In addition, the prior-art repair methods fail to recognize the unique problems associated with weakened piles located in river beds. That is, piles on the upstream side of a bridge must withstand the forces due to ice jams and debris which floats down a river. Consequently, a weakened pile must be repaired so that it has sufficient strength to withstand the normal forces generated by the river. In addition, river conditions cause breakdown of the repairs themselves. During spring thaw, the reinforcements for the wood piles become damaged from debris. Ice floating down the river can tear and rupture repairs made to the piles. The present invention not only provides pile splice which renders the strength of the repaired pile equal to or of greater strength than the original pile, but, when positioned with the flanges on the pile splice parallel to the flow of water through the bridge, provides a leading edge for breaking ice to minimize ice damage to the bridge. In addition, the present invention provides a pile splice which forms a mechanical link between two undecayed portions of the pile to provide both flexural and torsional strength to the pile while a filler provides the necessary compressive strength.

BRIEF DESCRIPTION OF THE PRIOR ART

U.S. Pat. No. 2,897,553 shows a utility pole-reinforcement device wherein split sleeve sections are provided with either hinges on the ends of the spill sleeve or slots and pins which can be slid over one another to form a tube with external helical fibs. They can be used to screw the split-sleeve device into the ground. This patent places a filler between the sleeve and the utility pole.

U.S. Pat. No. 4,306,821 shows a method and apparatus for restoring piling wherein radial spacers are placed on eroded piling and a split sleeve which forms a tongue-and-groove relationship with the opposite edge of the sleeve. A set of tensile fasteners is placed around the outside of the split sleeve to compress the units. An epoxy filler is forced into the gap formed between the split sleeve and the piling. This patent places spacers between the sleeve and the pile.

U.S. Pat. No. 5,337,469 shows a method of repairing poles in which the pole is severed and an enlarged sleeve is placed on a stub, with the top portion of the pole positioned in the sleeve. The sleeve is then filled with a grout to hold the top portion of the pole in position. This patent also teaches putting filler between the sleeve and the undamaged portion of the pole.

U.S. Pat. No. 5,226,751 shows a method for creating a controlled environment around a pile and then treating the pile to prevent it from deterioration.

U.S. Pat. No. 4,702,057 shows a method for repairing a utility pole in which a sleeve is positioned around the pole and a magnesium-phosphate cement is filled into the area around the utility pole. This patent also teaches putting filler between the sleeve and the undamaged portion of the pole.

U.S. Pat. No. 5,175,973 shows a method of repairing wood piles in which the pole is wrapped with layers of fiberglass strips saturated with a polyester or epoxy resin and overlapped with each other to form a support for the pole.

U.S. Pat. No. 3,362124 shows a method of reinforcing ribs located along plates which are nailed to the post. Bands are then tightened around the plates to hold the bands in position. A suitable filler, such as a fast-setting cement, is placed in the cavities. This patent requires cutting grooves into the post. In addition, separate bands are placed around the plates and then squeezed together to hold the plates in position.

SUMMARY OF THE INVENTION

Briefly, the pile protector and reinforcer comprise a pile spice formed from two rigid flanged sleeves and a method for reinforcing a deteriorated wood pile under a bridge wherein flanges of the pile splice are located parallel to the flow of water under the bridge and then positioned in a spaced relationship on the opposite side of the pile to permit squeezing the flanged sleeves directly around the pilings to form a mechanical link thereto but not with sufficient force to damage the wood piles. An epoxy filled into those decayed areas in which the wood pile has voids restores the compressive strength to the wood pile.

DESCRIPTION OF THE PREFERRED EMBODIMENT

Figure 1:
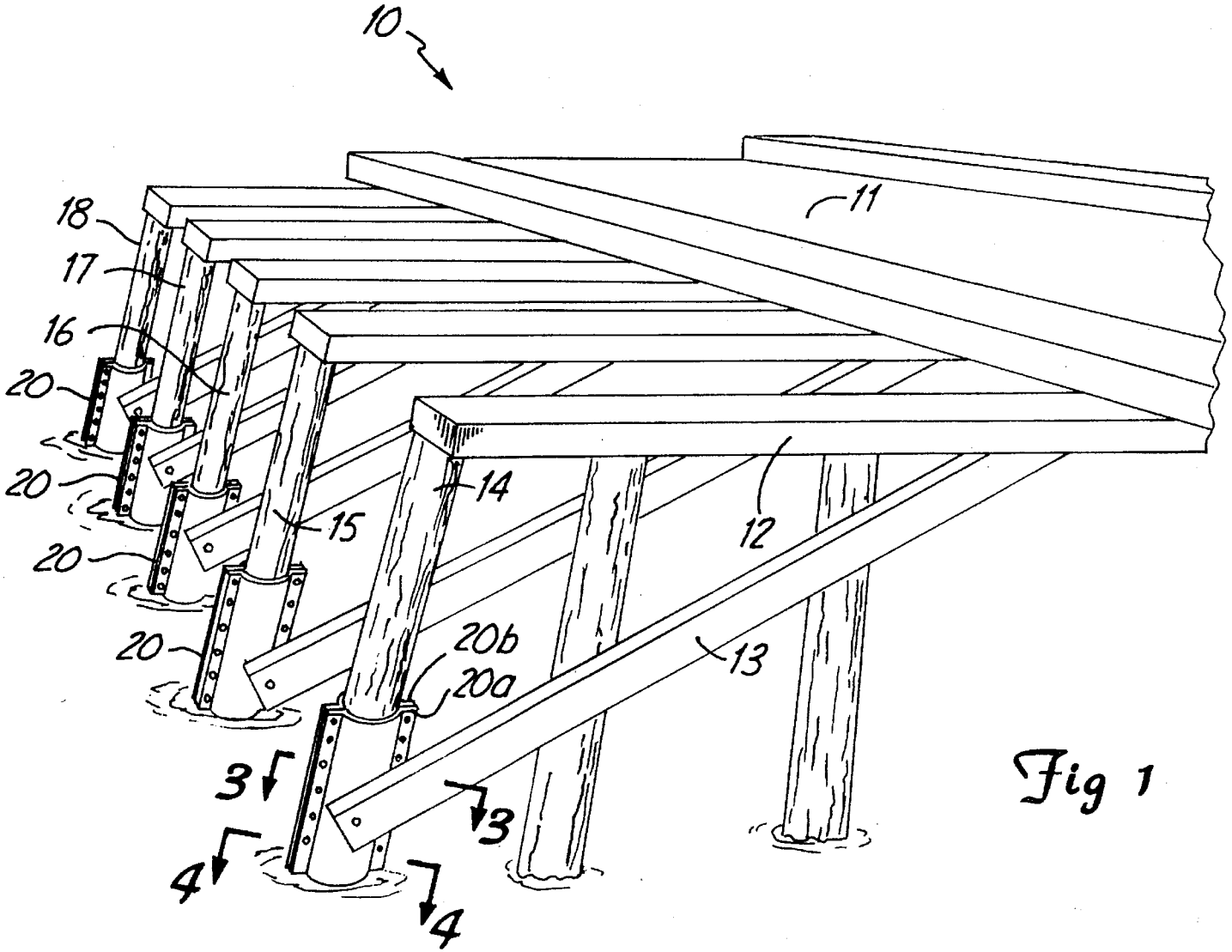
FIG. 1 shows a perspective of a bridge over a river with water flowing between the wood piles supporting the bridge.

FIG. 1 reference numeral 10 generally identifies a bridge having a deck 11 with a series of beams 12 which are supported by wood piles 14, 15, 16, 17 and 18. A cross brace 13 extends from each of the beams and or intermediate piles to a corresponding beam to provide rigidity to the bridge structure. Located on each of the wood piles is a pile splice 20 which protects and reinforces the pile. Pile splice 20 comprises a first flanged semi-cylindrical member **20*a* and a second flanged semi-cylindrical member 20*b*** which are listened around the piles to lock the pile splice mechanically to the wood pile.

Figure 2:
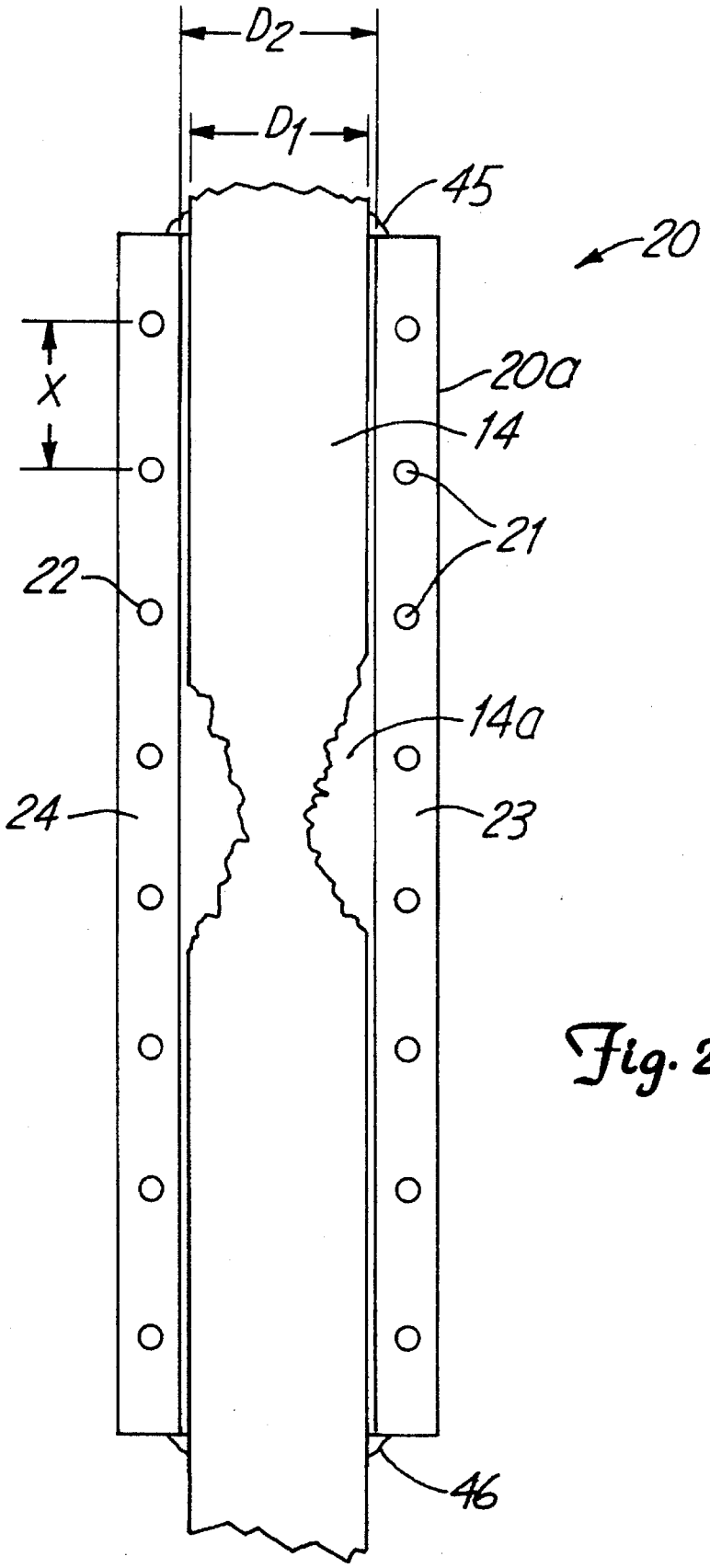
FIG. 2 shows a partial cutaway view of a wood pile with one sleeve secured to the wood pile with the sleeve extending outward beyond the deteriorated potion of the wood pile.

FIG. 2 shows a cutaway view of wood pile 14, with one part of pile splice 20 which comprises a flanged semi-cylindrical rigid member **20*a*** located thereon.

Figure 3:
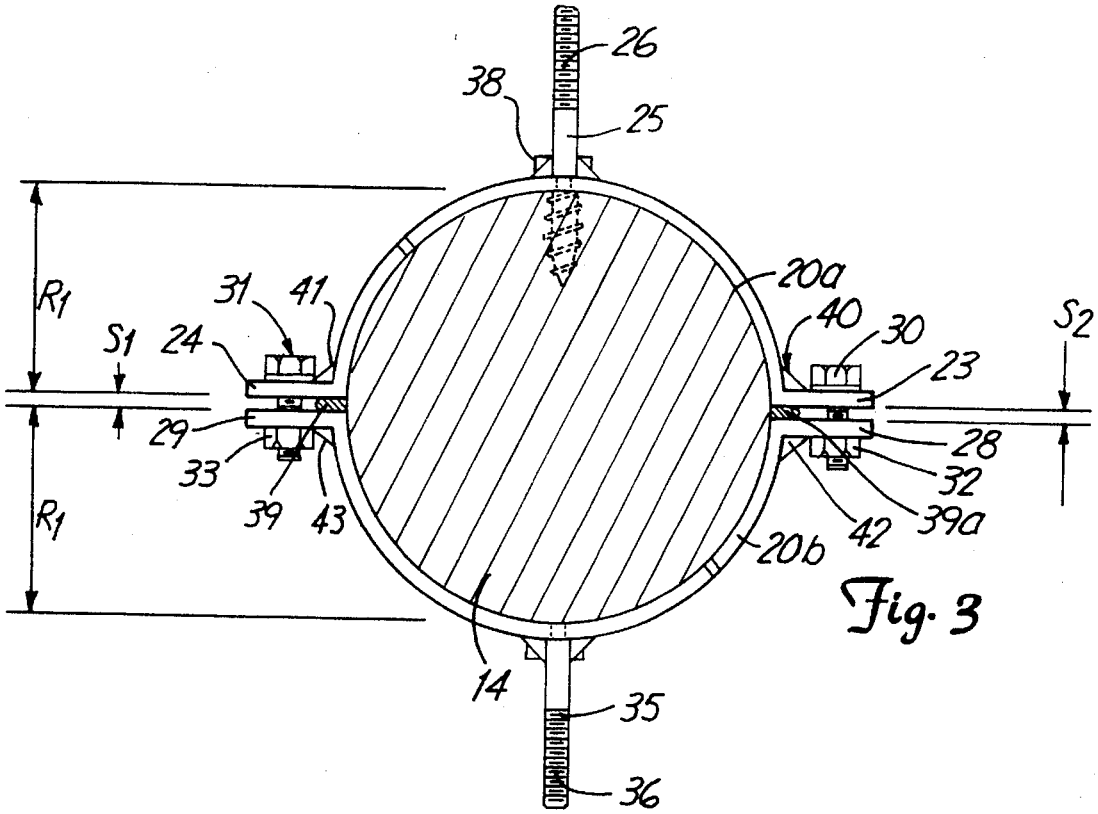
FIG. 3 shows a cross-sectional view taken along lines 3—3 of FIG. 1.

FIG. 3 shows a top view of the wood-pile protector and reinforcer or pile splice 20 formed of two members 20*a* and 20*b*. Pile splice 20 comprises two substantially identical semi-cylindrical members 20*a* and 20*b* (FIG. 3) which are fastened together to protect the wood pile. Member 20*a* includes a first flange 23 extending longitudinally along one side of member 20*a* and a second flange 24 extending longitudinally along the opposite side of member 20*a* with both of the flanges in substantial alignment with one another and both extending radially outward from the cylindrical member 20*a* to form a partial sleeve for forming a mechanical link to a wood pile through pressure contact therewith.

Member 20*a* comprises a standard steel pipe with a nominal 12-inch diameter and a ⅜-inch wall thickness which has been split longitudinally to form two substantially semi-cylindrical sections. Flanges 23 and 24 arc welded to opposite edges of one side of the split pipe. FIG. 3 shows that similar flanges 28 and 29 are welded to the other side of the split pipe to produce another cylindrical flanged member 20*b*.

FIG. 2 shows that located in flange 23 are a set of spaced holes 21, and similarly located in flange 24 are a set of spaced holes 22. The holes are spaced a distance denoted by "x" which is approximately 9 inches. The purpose of the close spacing is to maintain a relatively constant pressure between the pile and the pile splice over substantially the entire length of contact between the pile and the pile protector and reinforcer when pressure is applied.

FIG. 3 shows pile protector and reinforcer member 20*a* with flanges 23 and 24 positioned opposite pile protector and reinforcer member 20*b* with flange 29 opposite flange 24 and flange 28 opposite flange 23 with the openings in the respective flanges opposite one another to enable extending bolts therethrough. A bolt 30 extends through flanges 23 and 28 with a nut 32 secured to one end of bolt 30. Similarly, a bolt 31 extends through flanges 24 and 29 with a nut 33 secured to one end of bolt 33. While only two bolts are shown in FIG. 2, a plurality of bolts will be used to permit the flanges to be drawn together.

FIG. 2 shows wood pile 14 in a deteriorated condition, with an area designated by 14*a* representing a portion of the wood pile which has either been eroded away or removed to leave only the structurally sound portion of the wood pile. Typically, this area of decay occurs immediately above and below the waterline on the pile.

FIG. 3 shows that wood pile 14 has a diameter $R_1$ plus $R_1$ plus $S_1$ and that the inside radius of sleeve 20*a* is $R_1$ and the inside radius of sleeve 20*b* is also $R_1$. FIG. 3 clearly shows that, when the reinforcer is assembled, the inside diameter of the two pile protector and reinforcer members 20*a* and 20*b* is less than the outside diameter of wood pile 14. Consequently, placing pile protector and reinforcer members 20*a* and 20*b* around a wood pile produces a gap $S_1$ and a gap $S_2$. That is, a gap $S_1$ exists between flanges 24 and 29, and a gap $S_2$ exists between flanges 23 and 28. The gap allows the flanges to be drawn toward each other to bring a compressive force to the pile to form a mechanical link to the wood pile.

FIG. 3 shows a compressible filler 39 extending between flanges 23 and 28 and a compressible filler 39*a* extending between flanges 23 and 28. The purpose of having sleeves which do not fit tightly and snugly around the wood pile is to permit pile-protector and reinforcer-members 20*a* and 20*b* to be brought into compression around wood pile 14 with sufficient force so a mechanical link forms between the undecayed portions of the wood pile located on opposite sides of the decayed section of the wood pile. The two pile-protector and reinforcer-members 20*a* and 20*b* form a rigid connection thereto which provides rigidity and flexural strength to the wood pile. Forming the necessary mechanical linkage between portions of the wood pile requires squeezing the wood pile between the two members with a force less than that would damage the wood. Generally, an operator can observe the condition of the wood and stop compression of the members before the pile splice members bite into the wood pile, preferably not more than 1/16 of an inch.

FIG. 3 illustrates that pile protector and reinforcer 20*a* include a brace bolt 25 with a threaded section 26 for securing a brace thereto. A first lag bolt 38 and a second lab bolt 38*a* hold pile-protector and reinforcer-member 20*a* in position during the assembly of the two part pile-protector and reinforcer-members 20*a* and 20*b* about wood pile 14. Similarly, a brace bolt 35 having threads 36 extends outward from pile-protector and reinforcer-member 20*b*.

Figure 4:
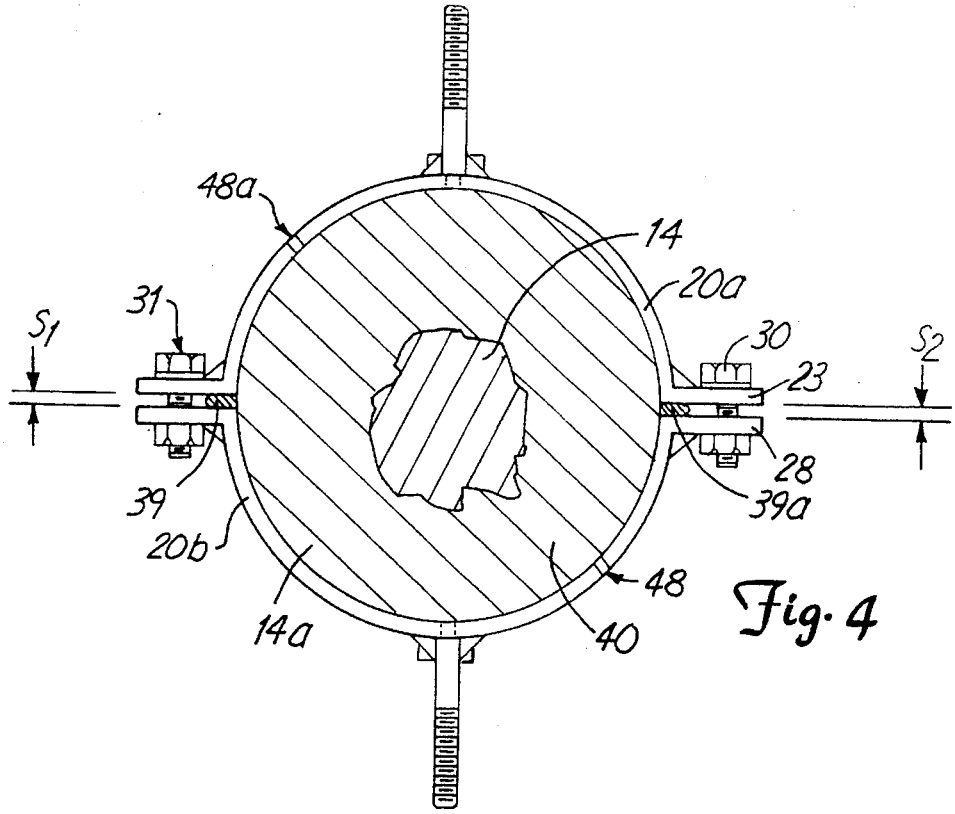
FIG. 4 shows a cross-sectional view taken along lines 4—4 of FIG. 1.

FIG. 4, which is taken along lines 4—4 of FIG. 1, shows that the void 14*a* has been filled with an epoxy 40. The purpose of using an epoxy is to place material into the recessed area of the wood pile to provide compressive strength for the repaired wood pile.

To illustrate the method of the present invention, refer to FIGS. 1 and 2. To place pile protector and reinforcer members 20*a* and 20*b* around a wood pile, the deteriorated wood in the wood pile is mechanically or hydraulically removed. Generally, the deteriorated wood extends a few feet above and below the waterline. Preferably, the reinforcer extends about 2 or more feet on opposite sides of the decayed region. It is this area of the wood pile which receives the greatest damage while the wood pile sections which are above and below the water usually remain in a sound condition.

FIG. 2 shows how the pile looks after the first step of the process, i.e. the removal of the decayed or deteriorated wood from post 14 to leave post 14 with a void area 14*a*.

In the next step, pile-protector and reinforcer-member 20*a* is secured to one side of wood pile 14 with lag bolts 38 and 38*a* to hold the pile protector and reinforcer with one portion above the waterline and another below the waterline. FIG. 1 shows that pile-protector and reinforcer-member 20*a* is placed so that the flanges are parallel to the flow of water between the pilings. This cause the flanges of opposite pile-protector and reinforcer-members to form a leading rigid edge which breaks ice. That is, ice or debris flowing down the river encounters the flange on the metal pile splice rather than the wood pile. Placing rigid pile-protector and reinforcer-members around the wood pile forms a pile splice which protects the wood pile from damage by flowing objects. Placing the flanges parallel to the water flow provides a longitudinal rib reinforcement along the line in which the wood pile is subject to the greatest river forces. Thus, the flexural strength can be restored to the pile with the metal pile splice of the present invention.

Next, one seals around the top and edges of the pile-protector and reinforcer-member 20*a*. FIG. 2 shows a sealant 46 placed around the lower end of pile-protector and reinforcer-member 20*a* and a sealant 45 placed around the top of pile-protector and reinforcer-member 20*a*. A compressible sealant 39 and 39*a* is positioned between the flanges to seal along the edges of the pile-protector and reinforcer-members. After sealing the ends and edges of the pile-protector and reinforccr-member 20*a*, a second pile-protector and reinforcer-member 20*b* is positioned on the opposite side of pile 14.

Next, bolts are extended through the flanges, nuts are fastened to the bolts and turned with a socket wrench or the like. Tightening the nuts on the bolts squeezes the flanges together to provide a radial compressive force to the wood pile. In the preferred method, the wood piles are squeezed sufficiently hard so they firmly grip the wood pile but not sufficiently hard so they force the metal pile protector and reinforcers into the wood, preferably not more than 1/16 of an inch. The range of pressure between the pile and the pile protector and reinforcers is usually about 150 psi but less than 250 psi bm varies depending upon the type and condition of the wood pile.

Finally, after compressing the pile-protector and reinforcer-members against the wood piles, a viscous epoxy is inserted through an opening 48 and 48*a* in pile-protector and reinforcer-member 20 and 20*b* until the void area 14*a* is completely filled with epoxy. After the epoxy sets, it forms an annular irregular plug which provides compressive strength to the damaged pile.

More specifically, the present process involves a method for repairing bridge supports wherein one removes a section of decayed wood from a portion of a wood pile supporting a bridge to leave a top region and a bottom region of the wood pile in substantially cylindrical shape and an intermediate region with a substantial portion 14*a* of the wood pile removed.

Fastening a first semi-cylindrical pile-protector and reinforcer-member 20*a* having a flange with a plurality of openings therein and an interior surface to a first side of the wood pile with a first end of the first semi-cylindrical pile protector and reinforcer extending onto the top region of the wood pile, and a second end of the first semi-cylindrical pile-protector and reinforcer-member extending onto the bottom region of the wood pile allows securing the semi-cylindrical pile-protector and reinforcer-member 20*a* to one portion of wood pile 14.

The next step involves fastening a second semi-cylindrical pile-protector and reinforcer-member 20*b* having a flange with a plurality of openings therein and an interior surface to a second side of the wood pile, with a first end of the first semi-cylindrical pile protector and reinforcer extending onto the top region of the wood pile, and a second end of the first semi-cylindrical flange extending onto the bottom region of the wood pile, with the flanges of the first semi-cylindrical pile-protector and reinforcer-members and the second semi-cylindrical pile-protector and reinforcer-members oppositely disposed from one another.

Positioning the semi-cylindrical pile-protector and reinforcer-members 20*a* and 20*b* squeezes the first semi-cylindrical pile protector and reinforcer 20*a* and the second semi-cylindrical flanged pile protector and reinforcer 20*b* around the wood pile through a plurality of compression members extending through the flanges until the first semi-cylindrical flanged pile-protector and reinforcer-member and the second semi-cylindrical flanged pile-protector and reinforcer-member firmly engage but do not crash the wood in the wood pile.

The cavity around the portion of the wood pile in which the decayed wood has been removed and the interior surface of the first semi-cylindrical pile protector member and reinforcer and the second semi-cylindrical pile-protector and reinforcer-member forms a mechanical link around the decayed portion of the wood pile which resists flexing and torsional forces on the wood pile.

Finally,one injects an epoxy filler under sufficient pressure through an opening in the first semi-cylindrical pile protector and reinforcer and an opening in the second semi-cylindrical pile protector into the cavity to thereby fill the cavity with epoxy to form a plug to support the wood pile during compression loading of the wood pile.

I claim:

1. A method for repairing bridge supports with a pile splice comprising the steps of:

removing a section of decayed wood from a portion of a wood pile supporting a bridge to leave a top undecayed region and a bottom undecayed region of the wood pile in substantially cylindrical shape and an intermediate region with a substantial portion of the wood pile removed;

fastening a first rigid semi-cylindrical pile-protector and reinforcer-member having a flange with a plurality of openings therein and an interior surface to a first side of the wood pile, with a first end of the first semi-cylindrical pile protector and reinforcer extending onto a first side of the top undecayed region of the wood pile and the a second end of the first semi-cylindrical pile protector and reinforcer extending onto a first side of the bottom undecayed region of the wood pile;

fastening a second semi-cylindrical pile-protector and reinforcer-member having a flange with a plurality of openings therein and an interior surface to a second side of the wood pile, with a first end of the first semi-cylindrical pile protector and reinforcer extending onto a second side of the top undecayed region of the wood pile and a second end of the first semi-cylindrical flange extending onto a second side of the bottom undecayed region of the wood pile, with the flanges of the first semi-cylindrical pile protector and reinforcer and the second semi-cylindrical pile protector and reinforcer oppositely disposed and spaced from one another;

squeezing a first portion of the first semi-cylindrical pile-protector and reinforcer-member and the second semi-cylindrical flanged pile-protector and reinforcer-member around the wood pile through a plurality of compression members extending through the flanges until a top end of the first semi-cylindrical flanged pile-protector and reinforcer-member and a top end of the second semi-cylindrical flanged pile-protector and reinforcer-member firmly engage but do not crush the top undecayed region of wood in the wood pile and squeezing a second portion of the first semi-cylindrical protector and reinforcer-member and the second semi-cylindrical flanged pile-protector and reinforcer-member around the wood pile through a plurality of further compression members extending through the flanges until a bottom end of the first semi-cylindrical flanged pile-protector and reinforcer-member and a bottom end of the second semi-cylindrical flanged pile-protector and reinforcer-member firmly engage but do not crush the bottom region of undecayed wood in the wood pile to thereby simultaneously form a mechanical link around the undecayed top and bottom portions of the wood pile to resist flexing and torsional forces on the wood pile and a cavity between the wood pile and the pile-protector and reinforcer-members;

injecting an epoxy filler under sufficient pressure through an opening in the first semi-cylindrical pile-protector and reinforcer-member and into the cavity to thereby fall the cavity with epoxy to form a plug to support the wood pile during a compression loading of the wood pile so that the wood pile is strengthen from torsional and flexing forces by the reinforcer-members and from compression by the plug.

2. The method of claim 1 wherein the compressive force on the wood pile is about 150 psi.

3. The method of claim 2 wherein the flanges are placed parallel to a flow of water around the pile.

4. The method of claim 3 of removing the decayed wood with pressure blasting of the wood pile.

5. The method of claim 4 including sealing the first end of the first semi-cylindrical pile-protector and reinforcer-member and the first end of the second semi-cylindrical pile protector and reinforcer to the wood pile.

6. The method of claim 5 of sealing the second end of the the first semi-cylindrical pile-protector and reinforcer-member and the second end of the second semi-cylindrical pile-protector and reinforcer-member to the wood pile.

7. The method of claim 6 including the step of securing the first semi-cylindrical pile protector and reinforcer to the wood pile with lag bolts before attaching the first semi-cylindrical pile protector to the second semi-cylindrical pile protector and reinforcer.

8. The method of claim 7 including the step of fastening a brace to an appendage on the first semi-cylindrical pile protector and reinforcer.

9. The method of claim 8 including leaving a space between opposite flanges to ensure that the first semi-cylindrical pile-protector and reinforcer-member and the second semi-cylindrical pile-protector and reinforcer-member can be squeezed into pressure contact with only an undecayed portion of the wood pile.

10. A pile splice for repairing a wood pile comprising:

a first metal semi-cylindrical pile-protector and reinforcer-member having a longitudinal axis, said first semi-cylindrical pile-protector and reinforcer-member having a first integral flange extending along a first longitudinal edge of said first semi-cylindrical pile-protector and reinforcer-member and a second flange extending along an opposite edge of said first semi-cylindrical pile-protector and reinforcer-member, with each of said flanges having a plurality of spaced openings therein;

a second metal semi-cylindrical pile-protector and reinforcer-member having a longitudinal axis, said second semi-cylindrical pile-protector and reinforcer-member having a first integral flange extending along a first longitudinal edge of said second semi-cylindrical pile-protector and reinforcer-member and a second flange extending along an opposite edge of said second semi-cylindrical pile-protector and reinforcer-member, with each of said flanges having a plurality of spaced openings therein so that when said first semi-cylindrical pile-protector and reinforcer-member and said second semi-cylindrical pile-protector and reinforcer-member are placed on opposite sides of a pile, the openings in the flanges are in register and the flanges are in a sufficiently spaced apart condition suitable for drawing the reinforcer-members toward each other sufficiently to firmly engage the pile; and a plurality of fasteners extending through the openings in the flanges of said first semi-cylindrical pile-protector and reinforcer-member and said second semi-cylindrical pile-protector and reinforcer-member, each of said fasteners having a threaded shank and a nut for engaging the thread shank so that one can squeeze the first semi-cylindrical pile-protector and reinforcer-member and the second semi-cylindrical pile-protector and reinforcer-member together until a mechanical link is formed between undecayed portions of a wood pile located on opposite sides of a decayed portion of the wood pile and the first semi-cylindrical pile-protector and reinforcer-member and the second semi-cylindrical pile-protector and reinforcer-member.

11. The device of claim 10 wherein the fasteners are spaced a minimum of 9 inches from one another to enable mechanical clamping of the pile-protector and reinforcer-member to the wood pile.

12. The device of claim 10 wherein the metal pile-protector and reinforcer-members have a thickness of at least ⅜-inch.

13. The device of claim 10 wherein the metal pile-protector and reinforcer-member comprises a longitudinal semi-cylindrical section of a standard steel pipe.

14. The device of claim 10 including members extending laterally from said pile-protector and reinforcer-members for attaching a brace thereto.

15. The device of claim 10 wherein the flanges of each of said semi-cylindrical pile-protector and reinforcer-member are located in an alignment with one another.

* * * * *